US006520488B1

(12) United States Patent
Braswell

(10) Patent No.: US 6,520,488 B1
(45) Date of Patent: Feb. 18, 2003

(54) HIGH PERFORMANCE POWER VALVE FOR A CARBURETOR

(75) Inventor: David Braswell, Marana, AZ (US)

(73) Assignee: POW Engineering, Inc., Marana, AZ (US)

( * ) Notice: Subject to any disclaimer, the term of this patent is extended or adjusted under 35 U.S.C. 154(b) by 0 days.

(21) Appl. No.: 09/713,657

(22) Filed: Nov. 15, 2000

Related U.S. Application Data

(60) Provisional application No. 60/165,536, filed on Nov. 15, 1999.

(51) Int. Cl.[7] ..... F02M 7/22

(52) U.S. Cl. ..... 261/51; 261/69.1; 261/DIG. 49; 261/DIG. 68

(58) Field of Search ..... 261/69.1, 51, 50.2, 261/23.2, 52, DIG. 49, DIG. 68

(56) References Cited

U.S. PATENT DOCUMENTS 2,394,663 A * 2/1946 Carlson et al. ..... 261/69.1 X
2,803,443 A * 8/1957 Dillon ..... 261/69.1 X
2,831,471 A * 4/1958 Schoonover ..... 261/69.1 X
3,235,237 A * 2/1966 Goetz et al. ..... 261/69.1 X
3,664,313 A * 5/1972 Walker ..... 261/69.1
3,680,846 A * 8/1972 Bickhaus et al. ..... 261/69.1 X
3,933,951 A * 1/1976 Fischer et al. ..... 261/69.1 X
3,983,189 A * 9/1976 Taylor ..... 261/69.1 X
4,190,028 A * 2/1980 Carlson et al. ..... 261/69.1 X
4,217,314 A * 8/1980 Dysarz ..... 261/69.1 X
4,224,908 A * 9/1980 Bier et al. ..... 261/69.1 X
4,295,450 A * 10/1981 Muscatell ..... 261/69.1 X

FOREIGN PATENT DOCUMENTS

JP 55-66642 * 5/1980 ..... 261/69.1

* cited by examiner

*Primary Examiner*—Richard L. Chiesa
(74) *Attorney, Agent, or Firm*—Birdwell, Janke & Durando, PLC

(57) ABSTRACT

A high performance power valve for a carburetor. The valve is operated by engine manifold vacuum. A housing is provided having an annular flange portion through which extend rectangular outlet apertures for conducting fuel received from a tubular aperture in the housing to a power valve channel restriction. Preferably, four such outlet apertures are disposed at radially symmetrically spaced intervals about the annular flange portion. Preferably, an interior surface of the tubular aperture is radiused substantially where this surface meets the outlet apertures. Preferably, a plunger disposed in the tubular aperture and a seat which the plunger contacts to shut off fuel flow through the valve when the valve is closed are both radiused. The annular flange portion preferably includes one or more "vanes" extending into the tubular aperture.

14 Claims, 5 Drawing Sheets

HIGH PERFORMANCE POWER VALVE FOR A CARBURETOR

This application claims the benefit of the inventor's provisional application, Ser. No. 60/165,536, filed Nov. 15, 1999, the entirety of which is incorporated by reference herein.

TECHNICAL FIELD

The invention relates generally to carburetors for internal combustion engines, and more particularly to power valve devices for step-wise increasing the amount of fuel provided to the carburetor when manifold vacuum drops below a predetermined level.

BACKGROUND OF THE INVENTION

Despite the ubiquitous use of fuel injection, carburetors remain in use in many internal combustion engines. Of particular interest are high performance carburetors used in racing engines and high-performance street engines. Professionals and amateurs alike strive to obtain the most useable power possible from engines used in vehicles for competitive and recreational purposes. Aftermarket carburetors and components, usually in combination with other engine parts, provide a ready means for substantially increasing the performance of a stock engine. Large after-market carburetor manufacturers such as Holley provide many products and much technical information to supply this market.

Basically, carburetors employ jets with calibrated holes to meter fuel from a float bowl that is filled with liquid fuel, such as gasoline or alcohol, to a Venturi tube throat wherein the fuel becomes mixed with air in the proper proportion for optimum combustion. The mixture of air and fuel is conducted through an intake manifold into the combustion chamber(s) of the engine. The amount of fuel delivered by the jets to the throat is dependent on the amount of air drawn through the throat by engine vacuum, which is controlled by opening or closing a throttle valve that is typically disposed at the juncture of the carburetor and the intake manifold.

A power valve is an additional valve in the carburetor that operates in parallel with the jets to conduct an additional quantity of fuel from the float bowl to the throat when manifold vacuum reaches a predetermined low level, i.e., when the throttle is opened a sufficient amount. The valve improves the engine's responsiveness in making the transition from idle to full throttle and, therefore, improves acceleration.

The power valve is threadably received in a "metering block" that contains the jets and that is mounted to the carburetor so as to form one side of the float bowl. An exemplary prior art power valve and metering block are shown and described (particularly at pages 33–35 and 56–59) in the publication "Holley Tech" by Alex and Nancy Walordy, of Westbury, N.Y. (ISBN #0-941167-04-6), herein incorporated by reference in its entirety.

One end of the power valve includes a fuel inlet for admitting fuel from the float bowl into the valve. The other end of the power valve houses a diaphragm that is in fluid communication with the engine's intake manifold, the diaphragm being displaced by engine vacuum against a spring bias to hold the valve closed until the vacuum drops to a predetermined barometric pressure. When the manifold pressure drops to the predetermined level, the spring moves a plunger so as to unseat an inlet end of the plunger from an inlet seat of a tubular aperture through the valve for conducting fuel.

The metering block includes a frustoconical power valve receptacle. This receptacle typically has two holes therethrough that form ends of respective passageways in the metering block known in the art as a "power valve channel restrictions," leading to respective carburetor throats. There are typically four throats or barrels in high performance carburetors, and therefore two metering blocks.

The holes forming the ends of the power valve channel restrictions are typically not aligned along a diameter of the valve seat in high performance carburetors. Instead, they are typically biased toward the lower portions of the power valve receptacle to varying degrees, to prevent the tendency for the adjacent fuel level to uncover the holes and starve the engine when cornering or turning the vehicle.

The power valve is seated against an annular washer applied around the power valve receptacle that spaces an annular flange portion of the power valve above the power valve receptacle. Outlet holes or apertures extend from the interior passageway of the power valve through the annular flange portion of the power valve, forming a fuel outlet of the power valve. Fuel passing into the power valve at its inlet, through the interior passageway of the power valve, and out the outlet holes or apertures of the power valve moves through the annular space created between the annular flange portion of the power valve and the frustoconical power valve receptacle in the metering block and into the power valve channel restriction on its way to the carburetor throat.

In the earliest power valves, there were typically four or six circular holes, equally angularly spaced around the annular flange portion of the power valve. In modern power valves, the circular holes are typically replaced by two rectangular shaped apertures that are aligned along the diameter of the annular flange portion of the power valve, in an attempt to increase the flow rate through the valve, and to provide even flow to the power valve channel restrictions. The total area of the rectangular apertures is substantially larger than the area of the inlet of the power valve, in an attempt to maximize flow through the valve.

The metering block is a relatively closely toleranced and expensive part that is designed to meter the optimum amount of fuel required during maximum acceleration. The power valve, on the other hand, is a relatively inexpensive part that functions simply as an "on/off" switch and is designed for ease of replacement. As the valve is threaded into the metering block, the alignment of the aforementioned holes or apertures forming the outlet of the valves align unpredictably with respect to the power valve channel restrictions. This is especially so in high performance carburetors where the holes of the power valve channel restriction in the power valve seat are biased off the diameter, toward the lower portion of the power valve seat. These holes are therefore displaced from one another more than 180 degrees. Accordingly, a 180 degree rotation of the power valve is required to move from one position of the power valve wherein optimum alignment is achieved, to the next. Therefore, even if the carburetor's metering system is adjusted to perfectly accommodate the flow pattern provided by a particular prior art power valve, replacing that valve with another typically requires substantial readjustment.

The move to employing two diametrically opposed rectangular outlet apertures in the prior art power valve is believed to have resulted from a recognition of the importance, in high performance carburetors having multiple throats, of providing uniform flow to the power valve channel restrictions. However, the present inventor has recognized that there remains substantial imbalance in the fuel flow to the power valve channel restrictions remains which is detrimental to engine performance. This is because of the aforementioned unpredictability of alignment of the apertures when threading the power valve in to the metering block, especially in high performance carburetors.

The present inventor has recognized some additional problems with prior art power valves. As mentioned, the power valve is intended to function in combination with the metering system provided by the metering block as simply an on/off switch, with the metering block providing for metering of fuel. However, regardless of the amount of fuel the valves pass, a significant flow restriction or pressure drop is imposed in prior art power valves, and this detracts from the ability of the metering block to optimize flow. For example, the present inventor has found that there is a significant flow restriction at the inlet end of the plunger and the inlet seat of the tubular aperture.

Accordingly, there is a need for a high performance power valve for a carburetor that provides for reducing the flow restriction imposed by prior art power valves, and that may be used as a replacement part for an existing power valve in the carburetor.

SUMMARY OF THE INVENTION

The high performance power valve for a carburetor according to the present invention solves the aforementioned problems and meets the aforementioned need by providing, in one aspect, a housing having an annular flange portion through which extend more than two rectangular outlet apertures for conducting fuel received from a tubular aperture in the housing to one or more power valve channel restrictions. This achieves better alignment between the apertures and the power valve channel restrictions for balancing fuel flow to the power valve channel restrictions. Preferably, four such outlet apertures are provided at radially symmetrically spaced intervals about the annular flange portion.

In another aspect, preferably, an interior surface of the tubular aperture is radiused substantially where this surface meets the outlet apertures.

In yet another aspect, a high performance power valve for a carburetor according to the present invention provides a housing, a tubular aperture through the housing for conducting fuel, and a plunger disposed in the tubular aperture which contacts a seat thereof for shutting off fuel flow through the valve. The seat is preferably radiused a substantial amount compared to the thickness of the seat in the region where this contact is made for reducing flow restriction. The plunger is also preferably radiused a like amount in the region where this contact is made.

In still another aspect, a high performance power valve for a carburetor according to the present invention provides a housing having an annular flange portion through which extend one or more outlet apertures for conducting fuel, and a tubular aperture through the housing for conducting fuel to the outlet apertures, wherein the annular flange portion extends into the tubular aperture to form one or more "vanes" corresponding to the outlet apertures for reducing turbulence.

Therefore, it is a principal object of the present invention to provide a novel and improved high performance power valve for a carburetor.

It is another object of the present invention to provide a high performance power valve for a carburetor that provides for reducing the flow restriction imposed by prior art power valves.

It is yet another object of the present invention to provide such a high performance power valve for a carburetor adapted for employing a prior art power valve.

It is still another object of the present invention to provide such a high performance power valve that can be employed as a replacement part for the prior art power valve.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1B:
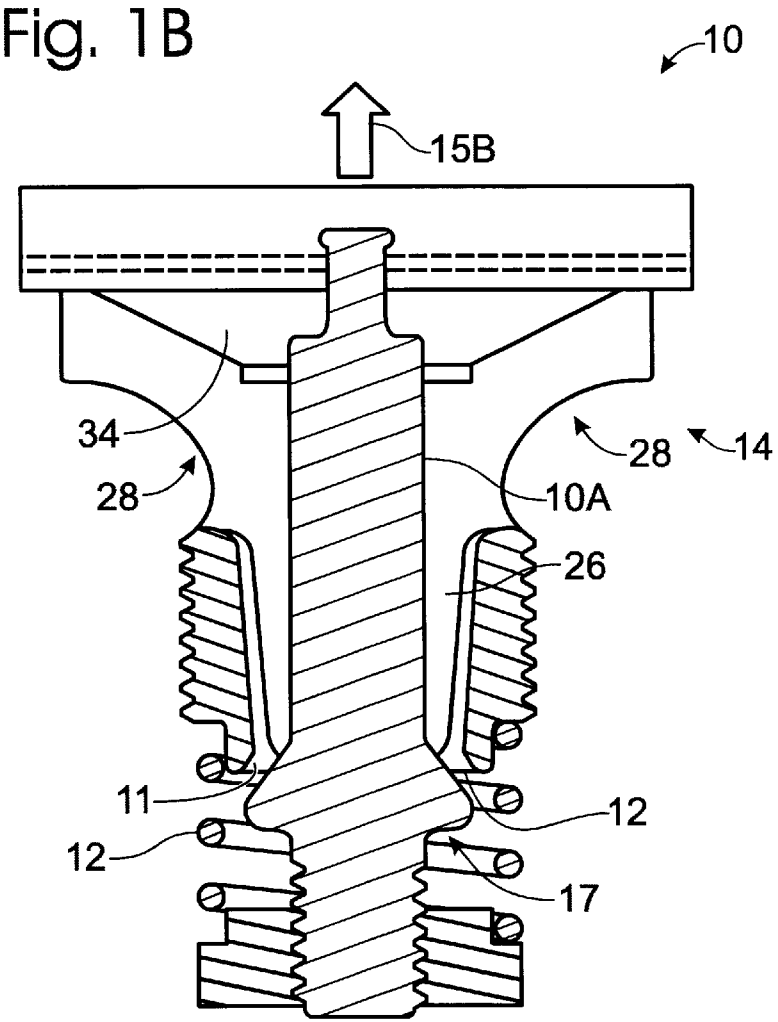
FIG. 1B is a cross-section of the high performance power valve of FIG. 1A, shown in an open position.
Figure 1A:
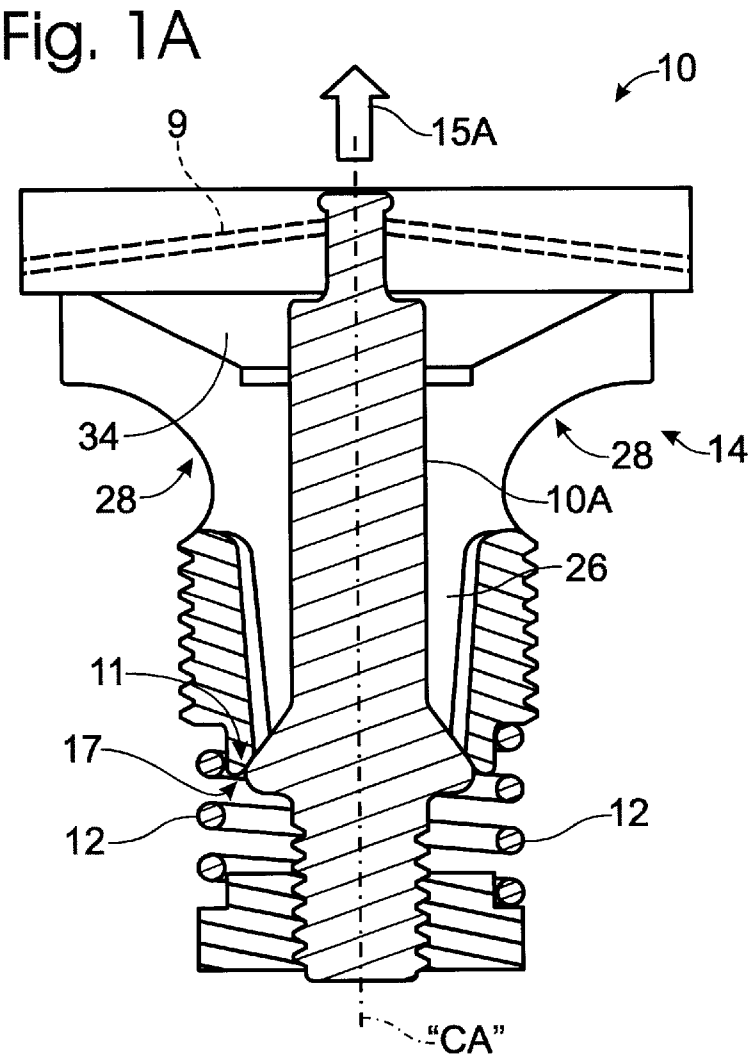
FIG. 1A is a cross-section of a high performance power valve for a carburetor according to the present invention, shown in a closed position.

Referring to FIGS. 1A and 1B, a power valve 10 for a carburetor according to the present invention is shown. In FIG. 1A, the power valve is closed and therefore cannot not conduct fuel therethrough, while in FIG. 1B, the power valve is open for conducting fuel. With particular reference to FIG. 1A, a housing 14 is provided which is substantially radially symmetric about a central axis "CA," and a plunger 10A is coaxially disposed in the housing. Manifold vacuum indicated as 15A, acting on a diaphragm 9, overcomes the bias of a compression spring 12, seating an annular inlet end 17 of the plunger 10A against an annular inlet seat 11 of a tubular aperture 26 through the valve and thereby blocking fuel flow through the tubular aperture.

With particular reference to FIG. 1B, the bias of spring 12 is no longer overcome when the manifold vacuum 15B falls to a predetermined low level, corresponding to an open throttle. The inlet end 17 of the plunger is unseated from the inlet seat 11 of the tubular aperture, and fuel is able to flow past the seat 11, over the end 17 and through the tubular aperture 26, where the fuel exits the power valve through outlet apertures 28.

Figure 2:
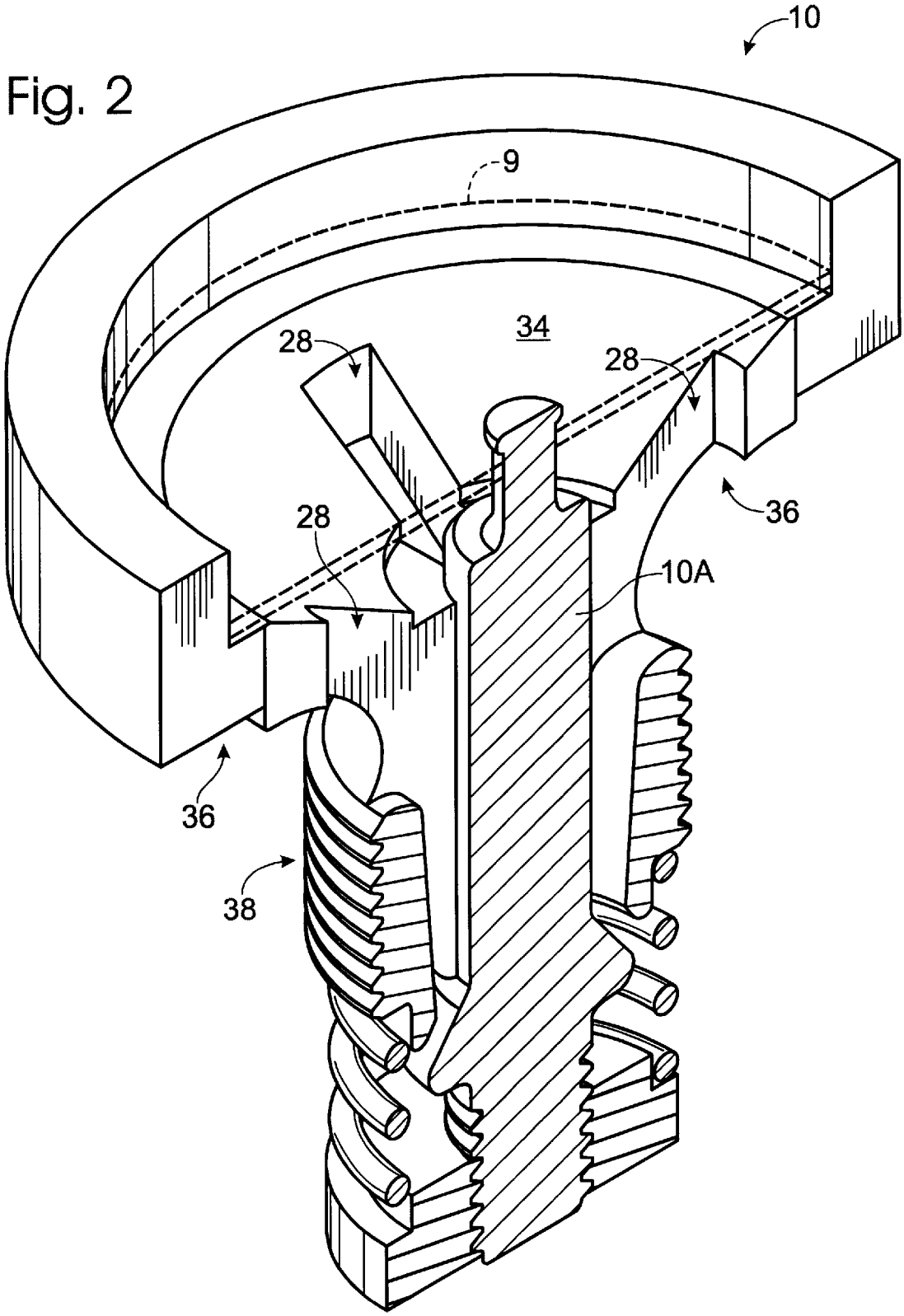
FIG. 2 is a sectional pictorial view of the high performance power valve of FIGS. 1A and 1B.

Referring to FIG. 2, the outlet apertures 28 are provided symmetrically about an annular flange portion 34 of the power valve 10. As discussed previously, space 36 beneath the annular flange portion is bound by the frustoconical power valve seat of a metering block (not shown) in which the power valve is threadably received by a threaded portion 38 when installed. The fuel is constrained to flow around this space until it finds the holes commencing the power valve channel restriction.

Figure 3A:
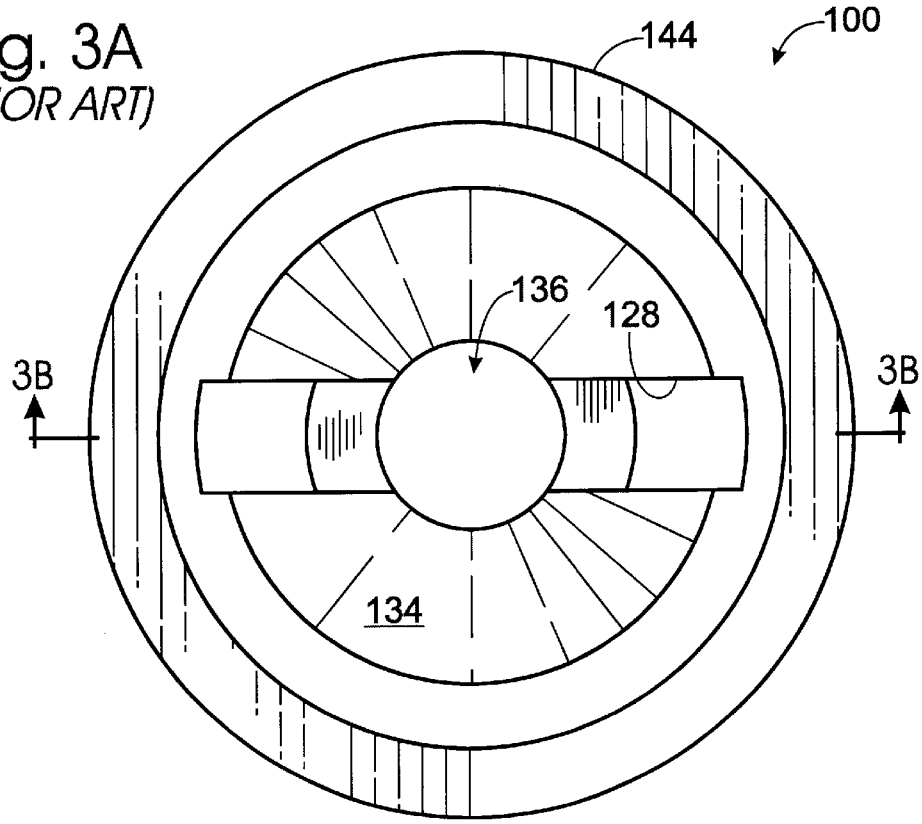
Fig. 3A (PRIOR ART)
FIG. 3A is a plan view of a housing of a prior art power valve.
Figure 3B:
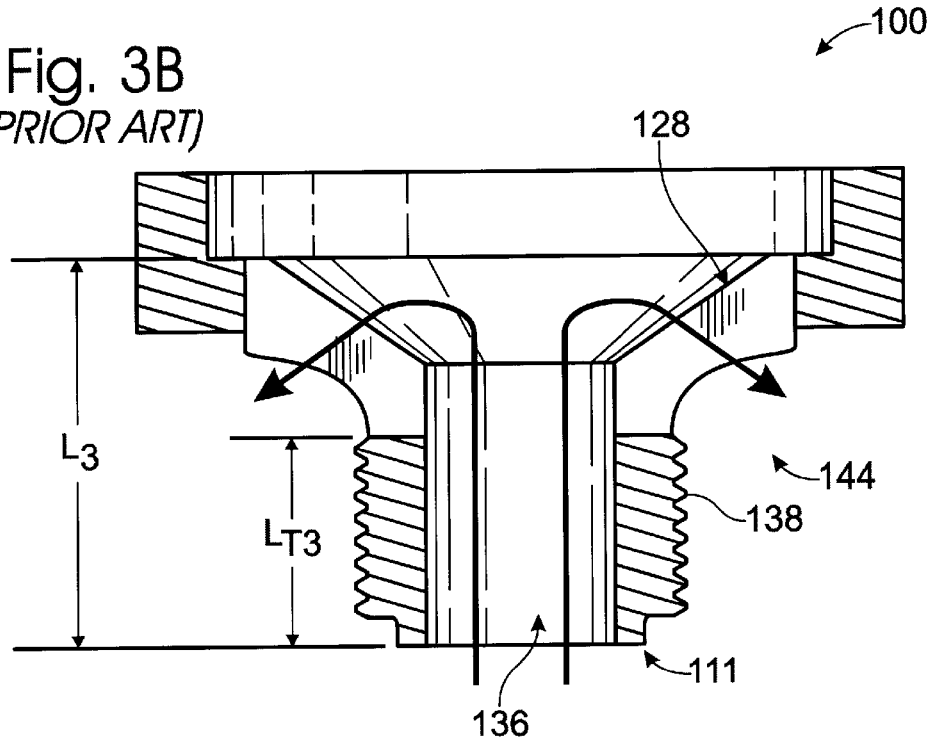
Fig. 3B (PRIOR ART)
FIG. 3B is a side section of the housing of FIG. 3A, taken along a line 3B—3B.

All of what has been stated so far about FIGS. 1A, 1B and 2 applies equally well to prior art power valves as to power valves according to the present invention. Turning now to FIGS. 3A and 3B, a housing 144 for a particularly popular prior art power valve 100 is shown to provide a basis for comparison for the power valve 10. Two outlet apertures 128 are provided symmetrically, i.e., radially spaced at 180 degree intervals, about the annular flange portion 134 of the power valve 100. A tubular aperture 136 extends through the power valve for conducting fuel through the valve. A plunger 110A resides coaxially in the aperture 136, the plunger being omitted from FIGS. 3A and 3B to increase clarity. Fuel follows the path of the arrows in FIG. 3B when the valve 100 is open.

Figure 4A:
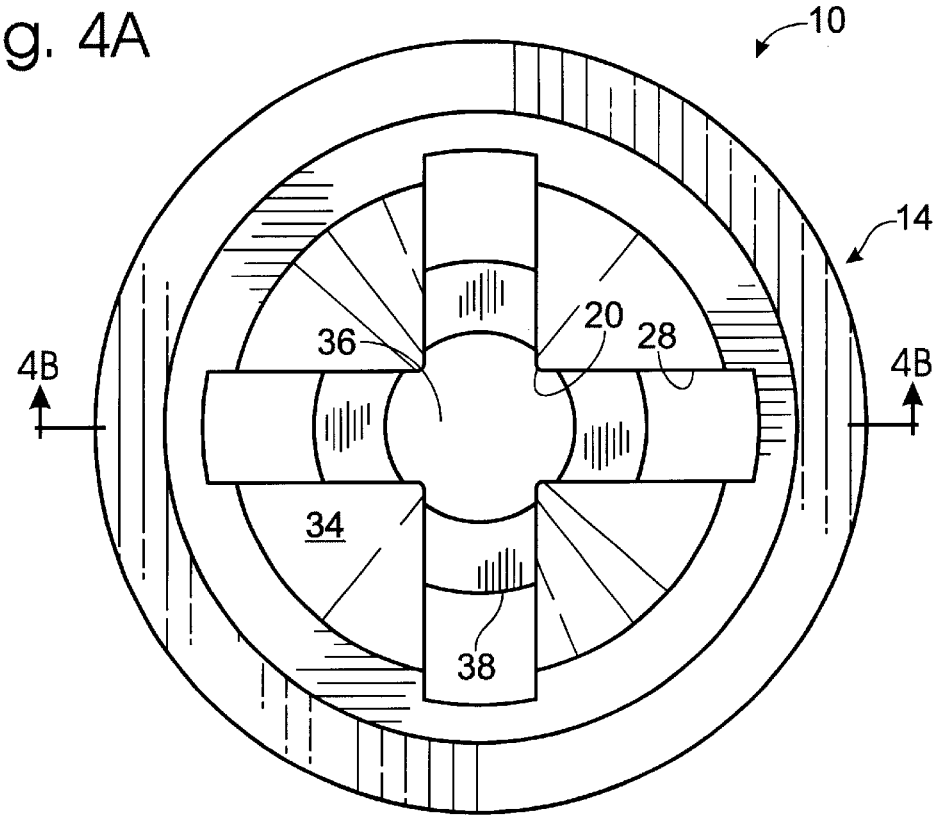
FIG. 4A is a plan view of a housing for a high performance power valve for a carburetor according to the present invention.
Figure 4B:
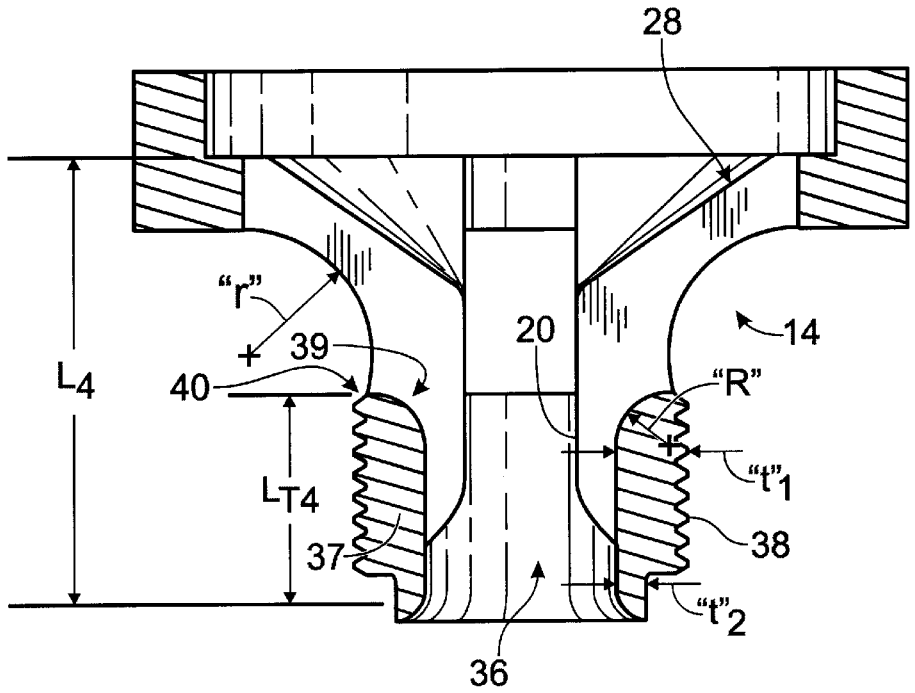
FIG. 4B is a side section of the housing of FIG. 5A, taken along a line 4B—4B.

Turning to FIGS. 4A and 4B, the housing 14 of the power valve 10 preferably provides four substantially rectangular outlet apertures 28 symmetrically, i.e., radially spaced at 90 degree intervals, about the annular flange portion 34. This contrasts with the two substantially rectangular outlet apertures of the prior art valve 100.

An outstanding advantage of the use of more than two rectangular outlet apertures is in the provision of finer symmetry requiring less rotation to align the pattern of the outlet apertures to a given power valve channel restriction. This results in a decrease in misalignment of the outlet apertures to the power valve channel restriction due to threading the power valve into the metering block an amount that cannot be closely controlled. The decrease in misalignment also decreases flow restriction from the tubular aperture, through the space 36 (FIG. 2), and out the outlet apertures.

The present inventor has also recognized that prior art power valves present significant fuel flow restrictions. However, the area provided by prior art outlet apertures is significantly larger than the area represented by the inlet to the valve, defined by the opening between the inlet end of the plunger and seat of the tubular aperture when the valve is open. Therefore, increasing fuel outlet area is not the solution to the problem.

Comparing FIGS. 3B and 4B, the length $L_4$ of the valve 10 according to the present invention is greater than the corresponding length $L_3$ of the prior art valve 100, whereas the length $L_{T4}$ of the threaded portion 38 of the valve 10 is substantially equal to the length $L_{T3}$ of a corresponding threaded portion 138 of the valve 100. Therefore, according to the invention, additional length of the valve 10 is provided in the outlet apertures 28, to provide a gentler radius "r" corresponding to the exterior surface of the annular flange portion through which the apertures extend, which lessens the resistance to fuel flow. Preferably, the radius "r" is at about equal to the length $L_{T4}$.

Also according to the invention, a radius "R" (FIG. 4B) at an outlet end 39 of the tubular aperture is provided. Preferably, the radius "R" is as large as possible, e.g., about equal to the wall thickness "$t_1$" of a wall 37 of the circular body 38, and is preferably at least about ¼ of the thickness of this wall. The radius "R" reduces turbulence in the fuel flowing along the path of the arrow in FIG. 3B, and therefore flow resistance is decreased relative to the prior art valve 100.

The inlet seat 11 of the tubular aperture 38 for the valve 10 also differs from the corresponding seat 111 of the prior art valve shown in FIG. 3B. Particularly, the inlet seat 11 is radiused a substantial amount compared to the thickness "t" thereof Preferably the radius is as large as possible and is preferably at least about ¼ of the thickness "$t_2$." Turbulence and flow resistance is further decreased relative to the prior art valve 100.

Figure 5:
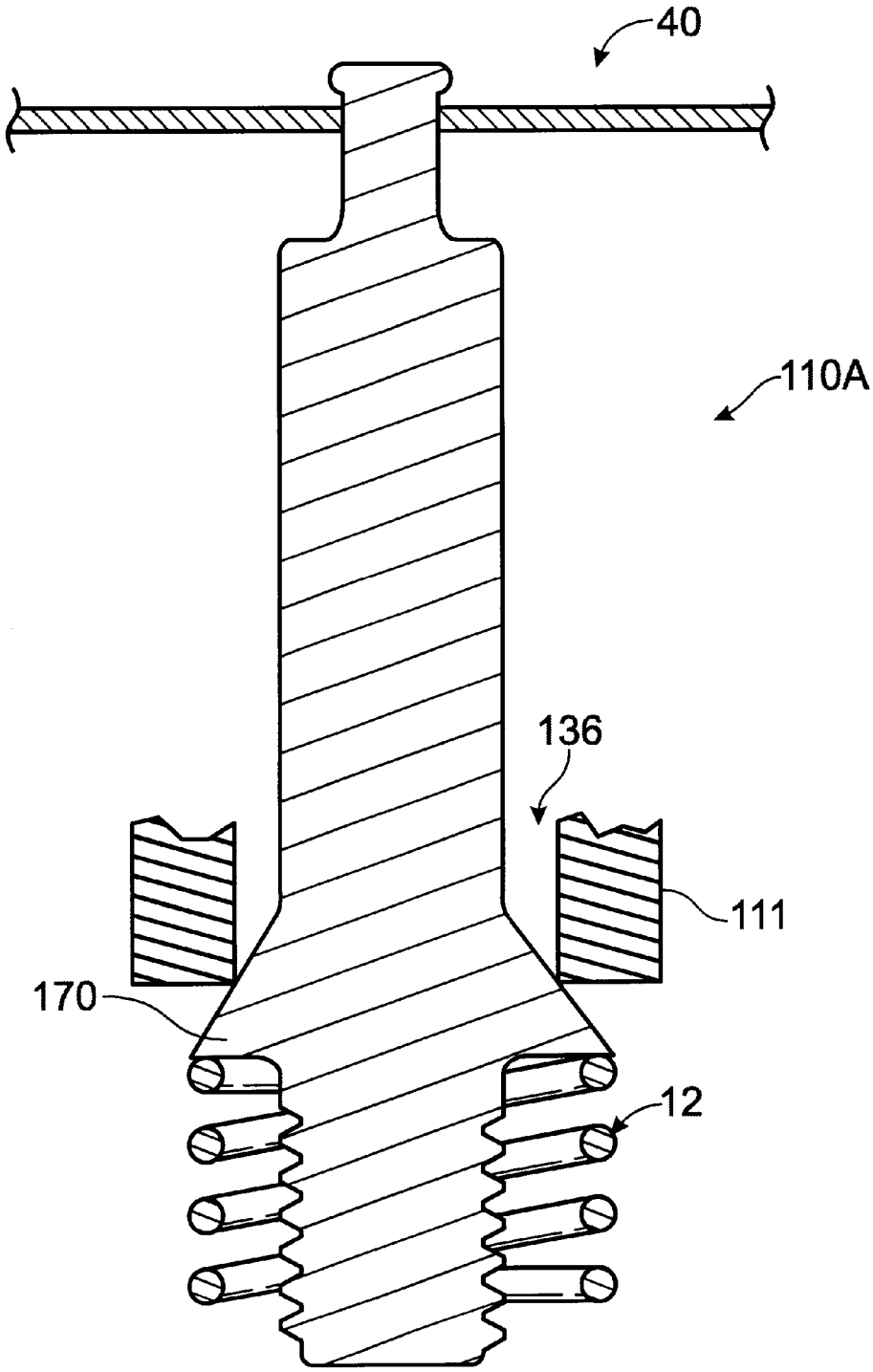
Fig. 5 (PRIOR ART)
FIG. 5 is a side section of a plunger of a prior art power valve.

Turning to FIG. 5, a prior art plunger 110A is shown to provide a basis for comparison with the power valve 10. The plunger 110A is coupled to a diaphragm 40 which operates against the spring bias of spring 12. When closed, the inlet end 170 of the plunger seats against the inlet seat 111 of the tubular aperture 136 (shown broken away from the remainder of the housing 144). Both the inlet end of the plunger and the inlet seat of the tubular aperture of the prior art have sharp corners which increase turbulence and restrict flow.

Comparing to FIG. 1A or 1B wherein the plunger 10A is shown, the inlet end 17 of the plunger is radiused according to the present invention in the region where contact is made between the plunger and the tubular aperture. This complements and cooperates with the radius of the inlet seat of the tubular aperture shown in FIG. 4B to minimize turbulence and therefore substantially improves the performance of the power valve 10.

The aforementioned modifications to the prior art valve have provided the outstanding advantages of improved balancing of flow between a plurality of power valve channel restrictions, particularly for replacement power valves, and decreased flow resistance for enhancing the capability of the metering block to meter fuel optimally. However, the present inventor has further recognized that the aforementioned modifications reduce but do not completely eliminate turbulence.

In response to this recognition, the valve 10 according to the present invention also preferably includes a feature not present in the prior art valve 100. Referring back to FIG. 4A, the annular flange portion 34 intrudes into the tubular aperture 36, past the inside surface 37 of the circular body 38 that defines the tubular aperture, to form what is referred to herein as a "vane" 20. As best seen in FIG. 4B, there is preferably though not necessarily a vane for each outlet aperture 28. The vanes are elongate features that extend downwardly, from the annular flange portion of the valve, along the interior of the tubular aperture 36, at least past the ends 40 of the outlet apertures 28. Preferably, the vanes are radiused as shown in FIG. 4A; however, this is not essential to their function.

The vanes preferably cooperate with the plunger 10A to ensure that the plunger slides coaxially in the aperture 36. The vanes also "channel" the fuel to the outlet apertures, further reducing turbulence and therefore restriction to fuel flow.

It is to be recognized that, while a particular high performance power valve for a carburetor has been shown and described as preferred, other configurations and methods could be utilized, in addition to those already mentioned, without departing from the principles of the invention. It should be noted that, although a number of improvements have been shown, it is not essential to include or employ all of the features provided by the present invention together to realize at least some of its advantages.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A power valve for a carburetor for an internal combustion engine, comprising:

a substantially radially symmetric housing having a central axis and including a tubular aperture extending concentrically therethrough, said tubular aperture having an inlet seat and an outlet end, said inlet seat being in fluid communication with a source of liquid fuel for the engine, said housing including a flange portion flaring outwardly from said tubular aperture;

a diaphragm having one side in fluid communication with the partial vacuum produced by the engine, said diaphragm being disposed in a first position when said vacuum is low and a second position when said vacuum is not low;

a plunger operably coupled at one end thereof to the other side of said diaphragm and being slidingly disposed within said tubular aperture, said plunger having an inlet end adapted to seat against said inlet seat of said tubular aperture and thereby substantially prevent the fuel from entering said tubular aperture when said plunger is in said second position, said inlet end of said plunger being adapted to be unseated from said inlet seat and thereby substantially permit the fuel to enter said tubular aperture when said plunger is in said first position, wherein said flange portion includes more than two substantially rectangular apertures therethrough, said apertures being in fluid communication with said outlet end of said tubular aperture.

2. The device of claim 1, wherein said apertures are radially symmetrically disposed in said flange portion with respect to said central axis of said housing.

3. The device of claim 2, wherein there are at least four of said apertures.

4. The device of claim 1, wherein said power valve has a threaded portion extending substantially beyond said inlet end of said tubular aperture for being threadingly received in a metering block, and wherein said apertures extend at least about the same length along said housing as said threaded portion.

5. The device of claim 1, wherein said inlet seat of said tubular aperture is radiused on the inside of said tubular aperture a substantial amount as compared to the thickness of said inlet seat.

6. The device of claim 5, wherein said inlet end of said plunger is also radiused a substantial amount as compared to the thickness of said inlet seat.

7. The device of claim 1, wherein said rectangular outlet apertures extend through said flange portion of said housing to respective vanes corresponding to said outlet apertures.

8. A power valve for a carburetor for an internal combustion engine, comprising:

a substantially radially symmetric housing having a central axis and including a tubular aperture extending concentrically therethough, an annular flange portion and one or more outlet apertures extending through said annular flange portion, said tubular aperture having an inlet seat in fluid communication with a source of liquid fuel for the engine;

a diaphragm having one side in fluid communication with the partial vacuum produced by the engine, said diaphragm being disposed in a first position when said vacuum is low and a second position when said vacuum is not low;

a plunger operably coupled at a first end thereof to the other side of said diaphragm and being slidingly disposed within said tubular aperture, said plunger having an inlet end adapted to seat against said inlet seat of said tubular aperture and thereby substantially prevent the fuel from entering said tubular aperture when said plunger is in said second position, said inlet end of said plunger being adapted to be unseated from said inlet seat and thereby substantially permit the fuel to enter said tubular aperture when said plunger is in said first position, wherein said annular flange portion includes respective vanes corresponding to said one or more outlet apertures.

9. The device of claim 8, wherein there are more than two of said outlet apertures.

10. A power valve for a carburetor for an internal combustion engine, comprising:

a substantially radially symmetric housing having a central axis and including a tubular aperture extending concentrically therethrough, said tubular aperture having an inlet seat in fluid communication with a source of liquid fuel for the engine;

a diaphragm having one side in fluid communication with the partial vacuum produced by the engine, said diaphragm being disposed in a first position when said vacuum is low and a second position when said vacuum is not low;

a plunger operably coupled at a first end thereof to the other side of said diaphragm and being slidingly disposed within said tubular aperture, said plunger having an inlet end adapted to seat against said inlet seat of said tubular aperture and thereby substantially prevent the fuel from entering said tubular aperture when said plunger is in said second position, said inlet end of said plunger being adapted to be unseated from said inlet seat and thereby substantially permit the fuel to enter said tubular aperture when said plunger is in said first position, wherein said inlet seat is radiused a substantial amount as compared to the thickness of said inlet seat to provide a curved surface on the inside of said tubular aperture.

11. The device of claim 10, wherein said inlet end of said plunger is also radiused a substantial amount as compared to the thickness of said inlet seat.

12. The device of claim 11, wherein said housing includes an annular flange portion and one or more outlet apertures extending through said annular flange portion, and wherein said annular flange portion includes respective vanes corresponding to said one or more outlet apertures.

13. A power valve for a carburetor for an internal combustion engine, comprising:

a substantially radially symmetric housing having a central axis and including a tubular aperture extending concentrically therethrough, an annular flange portion and one or more outlet apertures extending through said annular flange portion, and a threaded portion adapted for threading into a metering block of the carburetor, said tubular aperture having an inlet seat in fluid communication with a source of liquid fuel for the engine;

a diaphragm having one side in fluid communication with the partial vacuum produced by the engine, said diaphragm being disposed in a first position when said vacuum is low and a second position when said vacuum is not low;

a plunger operably coupled at a first end thereof to the other side of said diaphragm and being slidingly disposed within said tubular aperture, said plunger having an inlet end adapted to seat against said inlet seat of said tubular aperture and thereby substantially prevent the fuel from entering said tubular aperture when said plunger is in said second position, said inlet end of said plunger being adapted to be unseated from said inlet seat and thereby substantially permit the fuel to enter said tubular aperture when said plunger is in said first position, wherein an exterior surface of said annular flange portion through which said one or more apertures extend is curved with a radius about equal to or greater than the axial length of said threaded portion.

14. A power valve for a carburetor for an internal combustion engine, comprising:

a substantially radially symmetric housing having a central axis and including a tubular aperture extending concentrically therethrough defining a substantially cylindrical body of said housing, an annular flange portion and one or more outlet apertures extending through said annular flange portion, and a threaded portion adapted for threading into a metering block of the carburetor, said tubular aperture having an inlet seat and an outlet end, said inlet seat being in fluid communication with a source of liquid fuel for the engine;

a diaphragm having one side in fluid communication with the partial vacuum produced by the engine, said diaphragm being disposed in a first position when said vacuum is low and a second position when said vacuum is not low;

a plunger operably coupled at a first end thereof to the other side of said diaphragm and being slidingly disposed within said tubular aperture, said plunger having an inlet end adapted to seat against said inlet seat of said tubular aperture and thereby substantially prevent the fuel from entering said tubular aperture when said plunger is in said second position, said inlet end of said plunger being adapted to be unseated from said inlet seat and thereby substantially permit the fuel to enter said tubular aperture when said plunger is in said first position, wherein said housing includes a plurality of substantially rectangular apertures therethrough, said apertures being in fluid communication with said outlet end of said tubular aperture, and wherein said outlet end of said tubular aperture is radiused a substantial amount as compared to the thickness of said body to provide a curved surface on the inside of said tubular aperture.

* * * * *